US006236150B1

(12) United States Patent
Park

(10) Patent No.: US 6,236,150 B1
(45) Date of Patent: May 22, 2001

(54) MASK ASSEMBLY FOR CATHODE RAY TUBE HAVING AN ELECTRON BEAM INTERCEPTOR

(75) Inventor: Dong-min Park, Ulsan-si (KR)

(73) Assignee: Samsung Display Devices Co., LTD, Suwon-Si (KR)

( * ) Notice: Subject to any disclaimer, the term of this patent is extended or adjusted under 35 U.S.C. 154(b) by 0 days.

(21) Appl. No.: 09/167,430

(22) Filed: Oct. 6, 1998

(30) Foreign Application Priority Data

Oct. 8, 1997 (KR) ..... 97-51630

(51) Int. Cl.[7] ..... H01J 29/80
(52) U.S. Cl. ..... 313/402; 313/404; 313/407
(58) Field of Search ..... 313/402, 404, 313/407, 408, 403, 482

(56) References Cited

U.S. PATENT DOCUMENTS 4,626,737 * 12/1986 Takenaka et al. ..... 313/402
4,652,792 * 3/1987 Tokita et al. ..... 313/404
5,180,322 * 1/1993 Yamamoto et al. ..... 445/37
5,200,025 * 4/1993 Toei et al. ..... 156/640
5,814,928 * 9/1998 Matsudate et al. ..... 313/402

* cited by examiner

*Primary Examiner*—Nimeshkumar D. Patel
*Assistant Examiner*—Karabi Guharay
(74) *Attorney, Agent, or Firm*—Christie, Parker & Hale, LLP

(57) ABSTRACT

A mask assembly for a cathode ray tube includes a shadow mask for permitting electron beam to strike phosphor elements associated with the beam, a frame for supporting the shadow mask, and an electron beam interceptor which selectively passes electron beam and is mounted on the frame and between the shadow mask and an electron gun of the cathode ray tube. The electron beam interceptor is a metal sheet and includes a blocking mask on which a plurality of apertures are formed at the positions which correspond to the apertures of the shadow mask, and one or more supporter whose ends are adhered at the frame and the blocking mask to support the blocking mask in a funnel of the CRT.

17 Claims, 3 Drawing Sheets

MASK ASSEMBLY FOR CATHODE RAY TUBE HAVING AN ELECTRON BEAM INTERCEPTOR

CROSS REFERENCE TO RELATED APPLICATION

This application is based on application No. 97-51630 filed in Korean Industrial Property Office on Oct. 8, 1997, the content of which is incorporated herein by reference.

BACKGROUND OF THE INVENTION (a) Field of the Invention

The present invention relates to a mask assembly for a cathode ray tube (CRT), and more particularly, to a mask assembly for a CRT for reducing the amount of electron beam impinging on a shadow mask and thereby preventing doming phenomenon of the shadow mask.

(b) Description of the Related Art

Generally, a color CRT displays images by exciting phosphors with electron beams, and includes a screen on which red, green and blue color emitting phosphors are coated, an electron gun for forming three electron beams, a deflection yoke for directing the electron beams to the screen, and a shadow mask to permit each electron beam to strike only the phosphor elements associated with the beam.

The shadow mask is a thin sheet of metal, and includes a large central apertured portion through which the electron beams pass, a solid border portion surrounding the apertured portion, and a peripheral skirt portion angled from the border portions of the mask and directed to the electron gun, that is directed to opposite direction of a panel of the CRT. The apertures of the shadow mask are formed so as to correspond to the red, green and blue phosphors.

In the conventional shadow mask, approximately 20% of electron beam passes through the apertures formed on the shadow mask, and the remaining 80% of electron beam strikes the shadow mask to generate heat and raise the temperature of the shadow mask. Since the skirt portion of the shadow mask is firmly fixed to a frame of the CRT, the shadow mask is domed when it is heat-expanded. When the shadow mask is domed, the positions of apertures on the shadow mask are moved, and each electron beam can not strike the phosphor elements associated with the beam, but strikes the shadow mask or the phosphor of undesired colors. This results in the deterioration of the color purity of the CRT. The deterioration of the color purity due to the doming of the shadow mask and mis-landing of electron on the screen is generally called as "doming phenomenon".

To prevent or reduce the "doming phenomenon", a shadow mask made of Invar (an iron-nickel alloy) or a shadow mask on which powders of Invar are coated are developed. Since the Invar has very low heat expansion coefficient, the doming phenomenon is more or less reduced by using the Invar as the material of the shadow mask.

However, even though a material of low heat expansion coefficient is used to form shadow mask, the doming phenomenon is not fully reduced. Furthermore, there are disadvantages that the Invar is expensive and separate processing steps and various chemical compounds are required to coat the powder of the Invar on the shadow mask.

SUMMARY OF THE INVENTION

Accordingly, the present invention is directed to a mask assembly for a CRT which substantially obviates one or more of the problems due to the limitations and disadvantages of the related art. An object of the present invention is to provide a mask assembly for a CRT which can dramatically reduce the "doming phenomenon" and can be manufactured with low cost.

To accomplish these and other advantages, it is provided a mask assembly for a CRT which includes a shadow mask for permitting electron beam to strike the phosphor elements associated with the beam, and a frame for supporting the shadow mask. The mask assembly also includes an electron beam interceptor which selectively passes electron beam and is mounted on the frame at the opposite side of the shadow mask.

The electron beam interceptor is mounted between the shadow mask and an electron gun, and preferably includes a blocking mask on which a plurality of apertures are formed at the positions which correspond to the apertures of the shadow mask, and one or more supporters whose ends are adhered at the frame and the blocking mask, respectively, to support the mask in a funnel of the CRT.

The objects and other advantages of the invention will be realized and attained by the structure particularly pointed out in the following written description and claims hereof as well as the appended drawings.

BRIEF DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention.

In the drawings.

In the following detailed description, only the preferred embodiment of the invention has been shown and described, simply by way of illustration of the best mode contemplated by the inventor(s) of carrying out the invention. As will be realized, the invention is capable of modification in various other respects, all without departing from the invention. Accordingly, the drawings and description are to be regarded as illustrative in nature, and not as restrictive.

DETAILED DESCRIPTION OF THE INVENTION

Reference will now be made in detail to the preferred embodiment of the present invention, examples of which are illustrated in the accompanying drawings.

Figure 1:
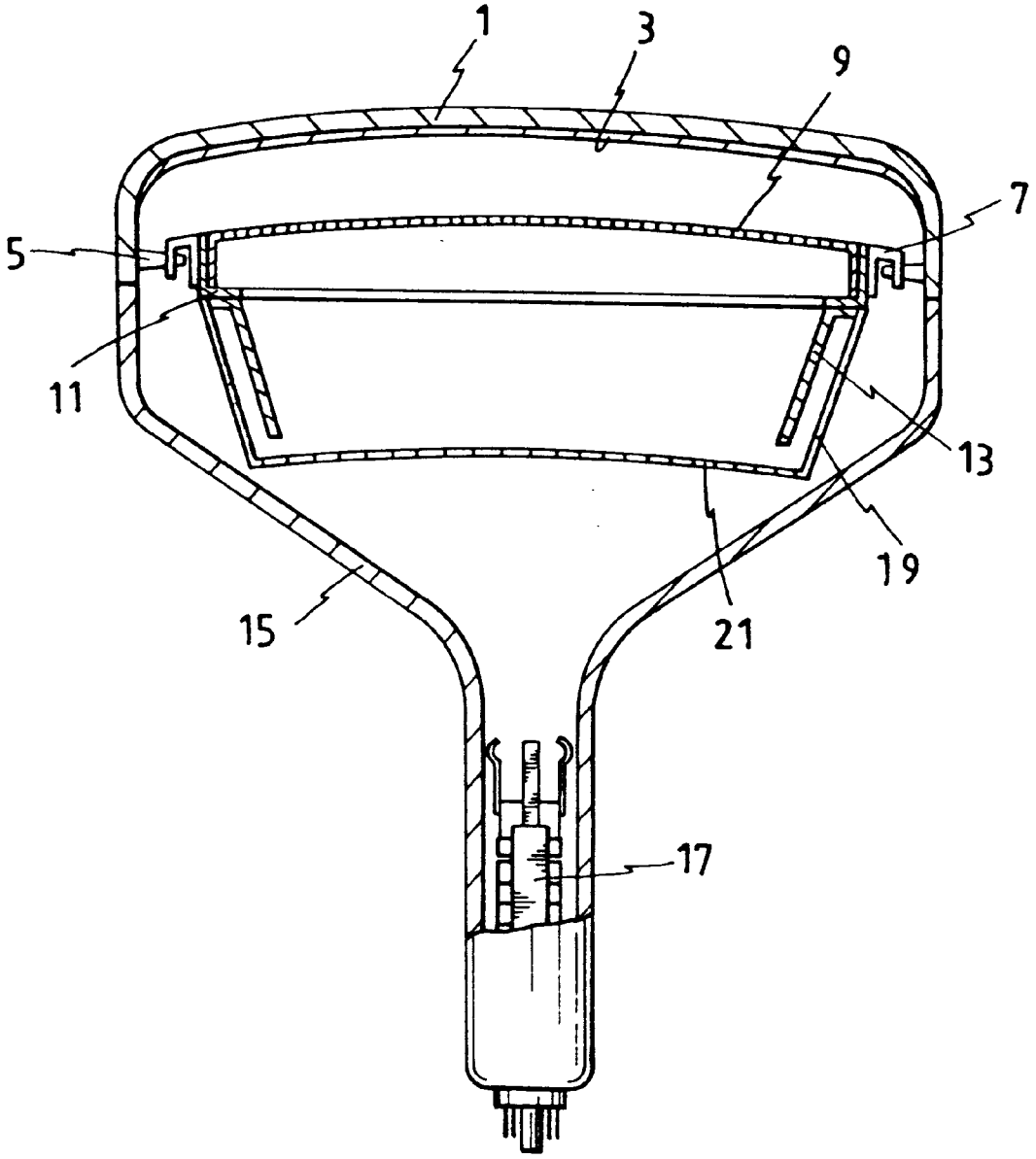
FIG. 1 is a cross section view of a CRT including a mask assembly according to a preferred embodiment of the present invention.

As shown in FIG. 1, the mask assembly for a cathode ray tube according to a preferred embodiment of the present invention includes a shadow mask 9, a frame 11 for supporting the shadow mask 9, and an electron beam interceptor which selectively passes electron beam and is mounted on the frame 11 at the opposite side of the shadow mask 9. The mask assembly preferably further includes an inner shield 13 for shielding earth magnetism.

Figure 3:
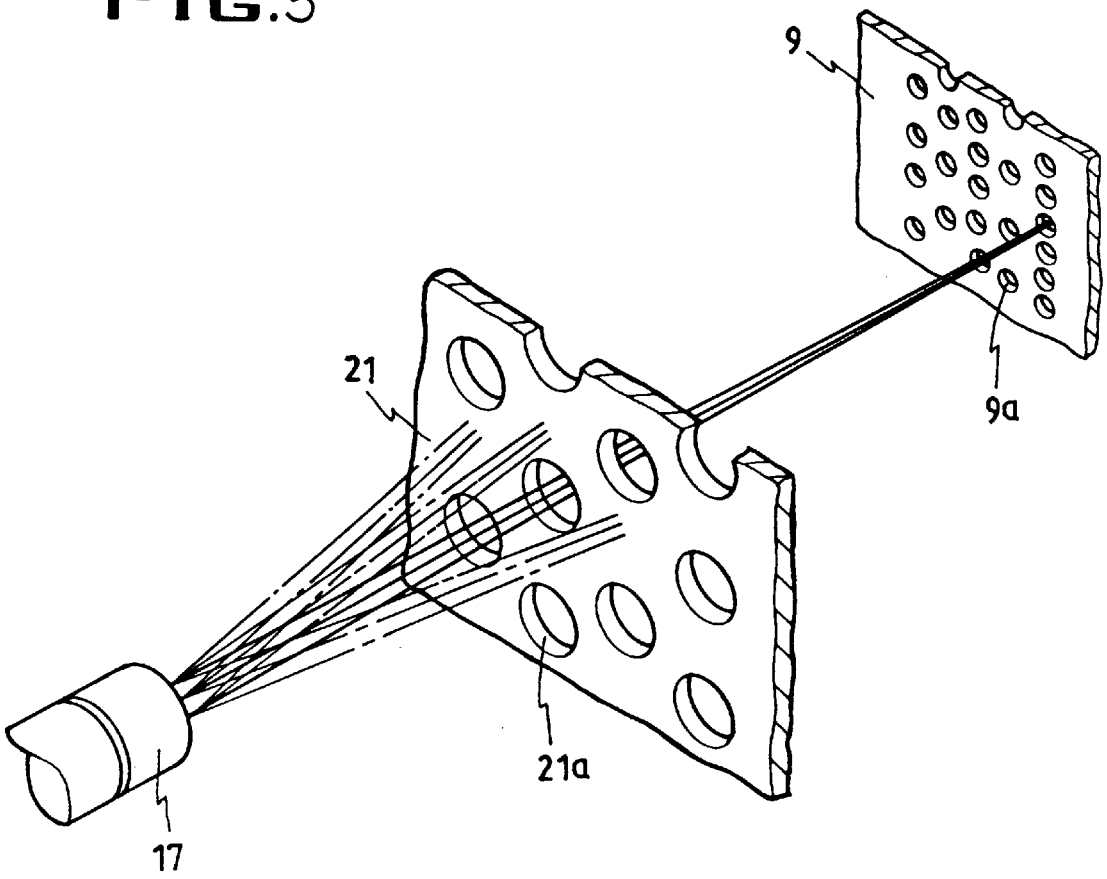
FIG. 3 is a perspective view showing the electron beams which pass a blocking mask and a shadow mask according to a preferred embodiment of the present invention.

The shadow mask 9 is provided to permit each electron beam generated by an electron gun 17 to strike only the phosphor elements 3 associated with the beam, and includes a large central apertured portion (See FIG. 3) on which a plurality of apertures 9*a* are formed so that the electron beams passes, a solid border portion surrounding the apertured portion, and a peripheral skirt portion angled from the solid border portion of the mask and directed to the opposite direction of a panel 1 of the CRT. The surface of the shadow mask 9 has the same curvature with the panel 1 of the CRT. In the preferred embodiment of the present invention, the shadow mask 9 is made of Aluminum Killed steel of low cost.

The frame 11 is provided to support the shadow mask 9, and an empty rectangular space to pass electron beams is formed at the central portion of the frame 11 and a spring 7 is fixed on the outer surface of the frame 11. The spring 7 is mounted on a stud pin 5 which is welded on the inner surface of the panel 1, therefore, the frame 11 is mounted on the inner surface of the panel 1. The inner shield 13 is fixed on a bottom part of the frame 11 by a inner shield clip (not shown in figures).

In conventional operation, when the shadow mask 9 permits each electron beam to strike only the phosphor elements 3 associated with the beam, approximately 80% of electron beam can not pass the aperture 9*a* of the large central apertured portion, and strikes the shadow mask 9 to generate heat and raise the temperature of the shadow mask 9. Due to the heat, shadow mask 9 is domed and the color purity of the CRT is deteriorated.

To prevent the doming of the shadow mask 9, the electron beam interceptor is provided. The electron beam interceptor absorbs electron beam which will strike the shadow mask 9, and preferably includes a blocking mask 21 on which a plurality of apertures 21*a* (See FIG. 3) are formed so that the apertures 21*a* of the blocking mask 21 correspond to the apertures 9*a* of the shadow mask 9, and one or more supporters 19 whose ends are adhered to the frame 11 and the blocking mask 21, respectively, to support the mask 21 in a funnel 15 of the CRT.

The blocking mask 21 is a thin sheet of metal that is contoured to somewhat parallel the surface of the shadow mask 9, and in the present invention, the blocking mask 21 is preferably formed of an Aluminum-Killed steel like the shadow mask 9. The apertures 21*a* of the blocking mask 21 are formed so that the electron beam can pass, and the diameters of the apertures 21*a* are determined according to the distance between the blocking mask 21 and the shadow mask 9. When the blocking mask 21 is near the funnel 15, the distance between the blocking mask 21 and the shadow mask 9 is maximized.

When the red, green and blue electron beams passes through the apertures 21*a*, the red, green and blue electron beams are not fully converged and have larger diameters with compared to the diameters of electron beams which pass the shadow mask 9, and the blocking mask 21 is also possibly domed. Thus, the diameters of the apertures 21*a* are preferably up to 5 times as large as the diameters of the apertures 9*a* of the shadow mask 9.

Figure 2:
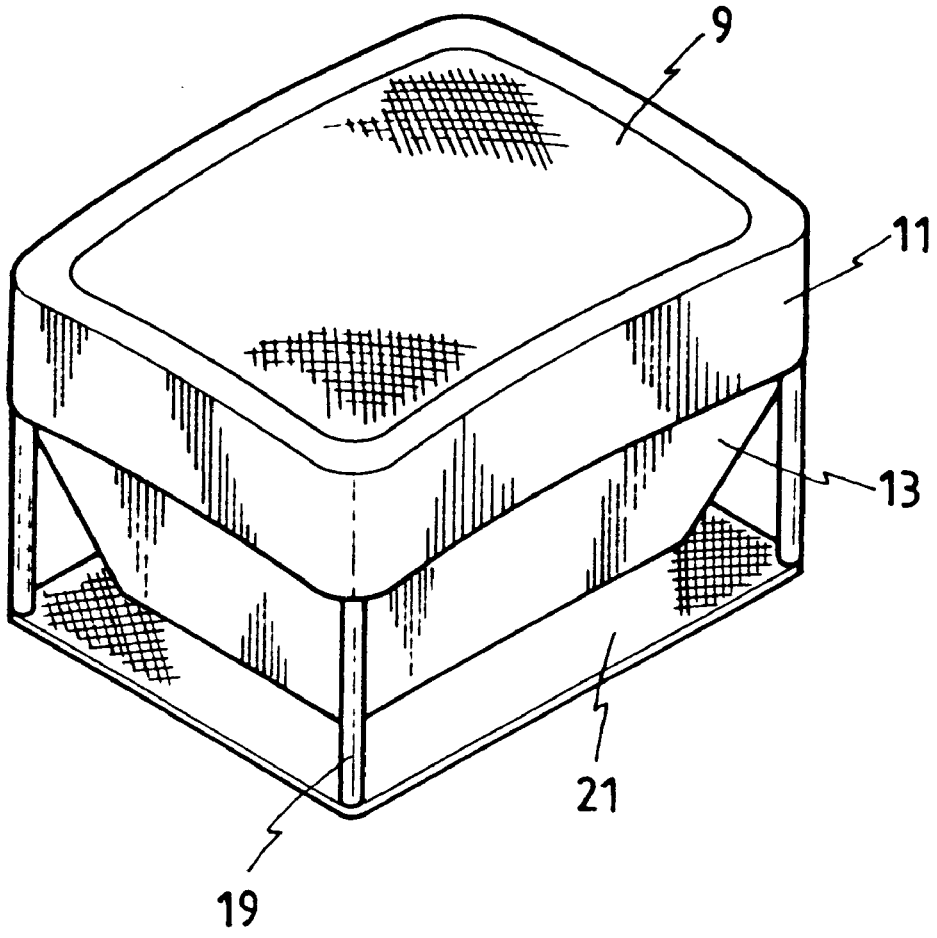
FIG. 2 is a perspective view of a mask assembly according to a preferred embodiment of the present invention.

As shown in FIG. 2, four supporters 19 are provided in the preferred embodiment of the present invention, and the supports 19 are rod-shaped whose ends are adhered to the frame 11 and the blocking mask 21 to support the mask 21 in the funnel 15 of the CRT.

Figure 4:
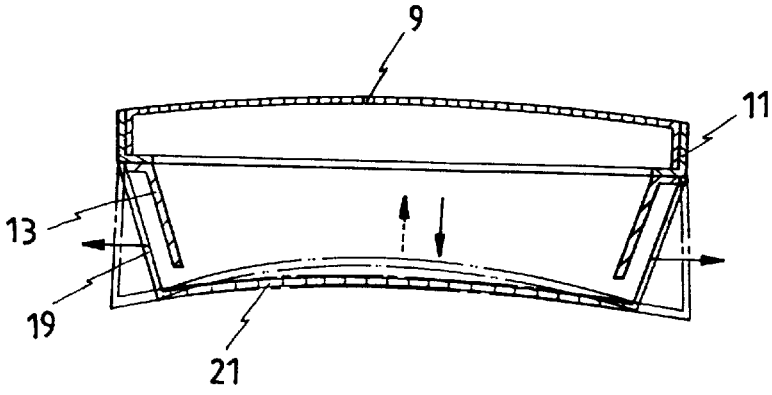
FIG. 4 is a cross section view of a mask assembly according to a preferred embodiment of the present invention.

As shown in FIG. 4, when electron beams strike the blocking mask 21, the blocking mask 21 is possibly domed (See the two vertical arrows in FIG. 4). However, if the electron beams strike the blocking mask 21, the supporters 19 are expanded (See the two horizontal arrows in FIG. 4) to prevent the doming of the blocking mask 21. In addition, since the diameters of the apertures 21*a* are larger than the diameters 9*a* of the shadow mask 9, the color purity of the CRT is not affected due to the doming of the blocking mask 21.

The mask assembly of the present invention includes a blocking mask for blocking electron beam which will strike the shadow mask, thus the doming of the shadow mask due to the heat-expansion is reduced and the color purity of the CRT is better even though the shadow mask is made of the Aluminum-Killed steel of low cost.

It will be apparent to those skilled in the art that various modifications and variations can be made in the a mask assembly for a cathode ray tube of the present invention without departing from the spirit or scope of the invention. Thus, it is intended that the present invention cover modifications and variations of this invention provided they come within the scope of the appended claims and their equivalents.

What is claimed is:

1. A mask assembly for a cathode ray tube, said cathode ray tube having a plurality of phosphors and an electron gun for emitting an electron beam toward the phosphors, said mask assembly comprising:

a shadow mask for permitting said electron beam to strike one of the phosphor elements associated with the beam, said shadow mask comprising a plurality of apertures;

a frame for supporting the shadow mask; and an electron beam interceptor for selectively passing the electron beam, said electron beam interceptor being mounted on the frame between the shadow mask and the electron gun, said electron beam interceptor comprising a metal sheet with a blocking mask having a plurality of apertures formed at positions corresponding to the apertures of the shadow mask; and at least one supporter having an end adhered to the frame, and another end adhered to the blocking mask to support the blocking mask in a funnel of the CRT.

2. The mask assembly of claim 1 wherein said shadow mask is contoured and the blocking mask is contoured substantially parallel with the shadow mask.

3. The mask assembly of claim 1 wherein said at least one supporter is expanded to prevent doming of the blocking mask when the blocking mask is heat-expanded by the electron beam.

4. The mask assembly of claims 1 wherein the blocking mask comprises Aluminum-Killed steel.

5. The mask assembly of claim 1 wherein the shadow mask comprises Aluminum-Killed steel.

6. A mask assembly for a cathode ray tube, said cathode ray tube having a plurality of phosphors and an electron gun for emitting an electron beam toward the phosphors, said mask assembly comprising:

a shadow mask for permitting said electron beam to strike one of the Phosphor elements associated with the beam, said shadow mask comprising a plurality of apertures a frame for supporting the shadow mask;

an electron beam interceptor for selectively passing the electron beam, said electron beam interceptor being mounted on the frame between the shadow mask and the electron sun, said electron beam interceptor comprising a metal sheet with a blocking mask having a plurality of apertures formed at positions corresponding to the apertures of the shadow mask; and a supporter having an end adhered to the frame, and another end adhered to the blocking mask to support the blocking mask in a funnel of the CRT;

wherein each of the apertures of the shadow mask comprises a diameter, and each of the apertures of the blocking mask comprises a diameter approximately five times larger than the diameter of each of the shadow mask apertures.

7. A mask assembly for a cathode ray tube, said cathode ray tube having a plurality of phosphors and an electron gun for emitting an electron beam toward the phosphors, said mask assembly comprising:

a shadow mask for permitting said electron beam to strike one of the phosphor elements associated with the beam, said shadow mask comprising a plurality of apertures, a frame for supporting the shadow mask;

an electron beam interceptor for selectively passing the electron beam, said electron beam interceptor being mounted on the frame between the shadow mask and the electron gun, said electron beam interceptor comprising a metal sheet with a blocking mask having a plurality of apertures formed at positions corresponding to the apertures of the shadow mask;

a supporter having an end adhered to the frame, and another end adhered to the blocking mask to support the blocking mask in a funnel of the CRT; and an inner shield mounted between the blocking mask and the frame.

8. A cathode ray tube, comprising:

a panel having a plurality of phosphors;

a funnel;

an electron gun for emitting an electron beam toward one of the phosphors, said electron gun being mounted in the funnel;

an electron beam interceptor disposed between the panel and the electron gun, said electron beam interceptor passing only a portion of the electron beam from the electron gun toward said one of the phosphors, said electron beam interceptor comprising a metal sheet with a blocking mask having a plurality of apertures; and a shadow mask disposed between the electron beam interceptor and the panel, said shadow mask passing said portion of the electron beam from the electron beam interceptor to said one of the phosphors, said shadow mask comprising a Plurality of apertures;

a frame for supporting the electron beam interceptor and the shadow mask; and at least one supporter having an end adhered to the frame, and another end adhered to the blocking mask to support the blocking mask in the funnel of the CRT;

wherein the plurality of apertures in the blocking mask correspond to the apertures of the shadow mask.

9. The cathode ray tube of claim 8 wherein said shadow mask is contoured and the blocking mask is contoured substantially parallel with the shadow mask.

10. The mask assembly and the cathode ray tube of claim 8 wherein said at least one supporter is expanded to prevent doming of the blocking mask when the blocking mask is heat-expanded by the electron beam.

11. The mask assembly and the cathode ray tube of claim 8 wherein the blocking mask comprises Aluminum-Killed steel.

12. The mask assembly and the cathode ray tube of claim 8 wherein the shadow mask comprises Aluminum-Killed steel.

13. The mask assembly and cathode ray tube of claim 8 wherein each of the apertures of the shadow mask comprises a diameter, and each of the apertures of the blocking mask comprises a diameter larger than the diameter of each of the shadow mask apertures.

14. A cathode ray tube comprising:

a panel having a plurality of phophors;

a funnel;

an electron gun for emitting an electron beam toward one of the phosphors, said electron gun being mounted in the funnel;

an electron beam interceptor disposed between the panel and the electron gun, said electron beam interceptor passing only a portion of the electron beam from the electron gun toward said one of the phosphors;

a shadow mask disposed between the electron beam interceptor and the panel, said shadow mask passing said portion of the electron beam from the electron beam interceptor to one of the phosphors, said shadow mask comprising a plurality of apertures; and a supporter having an end adhered to the frame, and another end adhered to the blocking mask to support the blocking mask in the funnel of the CRT;

wherein said electron beam interceptor comprises a metal sheet with a blocking mask having a plurality of apertures formed at positions corresponding to the apertures of the shadow mask; and wherein each of the apertures of the shadow mask comprises a diameter, and each of the apertures of the blocking mask comprises a diameter approximately five times larger than the diameter of each of the shadow mask apertures.

15. A mask assembly for a cathode ray tube, said cathode ray tube having a plurality of phosphors and an electron gun for emitting an electron beam toward the phosphors, said mask assembly comprising:

a shadow mask for permitting said electron beam to strike one of the phosphor elements associated with the beam;

a frame for supporting the shadow mask; and an electron beam interceptor for selectively passing the electron beam, said electron beam interceptor being mounted between the frame and the electron gun.

16. The mask assembly of claim 15, wherein the shadow mask comprises a plurality of apertures, and the electron beam interceptor comprises a blocking mask having a plurality of apertures formed at positions corresponding to the apertures of the shadow mask, the apertures in the shadow mask each comprising a diameter, and each of the apertures of the blocking mask comprising a diameter approximately five times larger than the diameter of its respective shadow mask aperture.

17. The mask assembly of claim 15 further comprising an inner shield positioned between the shadow mask and the blocking mask.

* * * * *